US007614704B2

(12) United States Patent
Whelan et al.

(10) Patent No.: US 7,614,704 B2
(45) Date of Patent: Nov. 10, 2009

(54) WHEELCHAIR SEAT CUSHION

(75) Inventors: Thomas J. Whelan, Longmont, CO (US); James L. Christofferson, Longmont, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 32 days.

(21) Appl. No.: 11/904,908

(22) Filed: Sep. 28, 2007

(65) Prior Publication Data

US 2008/0079306 A1 Apr. 3, 2008

Related U.S. Application Data

(60) Provisional application No. 60/848,417, filed on Sep. 29, 2006.

(51) Int. Cl.
*A47C 7/02* (2006.01)

(52) U.S. Cl. ..... 297/452.25; 297/452.26; 297/452.27; 297/DIG. 1

(58) Field of Classification Search ..... 297/452.25, 297/452.26, 452.23, 452.24, 452.27, DIG. 1, 297/DIG. 4; 5/655.5, 437, 653
See application file for complete search history.

(56) References Cited

U.S. PATENT DOCUMENTS 4,132,228 A * 1/1979 Green ..... 601/57
4,522,447 A * 6/1985 Snyder et al. ..... 297/452.27
4,571,763 A * 2/1986 Suzuyama et al. ..... 5/653
4,588,229 A 5/1986 Jay
4,660,238 A 4/1987 Jay
4,726,624 A 2/1988 Jay
4,753,480 A * 6/1988 Morell ..... 297/452.27
4,755,411 A * 7/1988 Wing et al. ..... 428/71
4,761,843 A 8/1988 Jay
4,842,330 A 6/1989 Jay
5,018,790 A 5/1991 Jay
5,062,677 A 11/1991 Jay
5,074,620 A 12/1991 Jay
5,149,173 A 9/1992 Jay
5,211,446 A 5/1993 Jay
5,294,181 A * 3/1994 Rose et al. ..... 297/452.25
5,333,921 A 8/1994 Dinsmoor, III
5,352,023 A 10/1994 Jay
5,362,543 A 11/1994 Nickerson
5,369,829 A 12/1994 Jay
5,378,045 A 1/1995 Siekman (Continued)

FOREIGN PATENT DOCUMENTS

FR 2324260 4/1977

(Continued)

*Primary Examiner*—David Dunn
*Assistant Examiner*—Erika Garrett
(74) *Attorney, Agent, or Firm*—MacMillan, Sobanski & Todd, LLC

(57) ABSTRACT

A wheelchair seat cushion has multi-density regions. The cushion assembly may have a region having a stiffer, higher density proximate the front of the seat cushion assembly beneath the user's thighs to assist the user in exiting the wheelchair. Alternatively, or additionally, an insert member having multi-density regions may be received in a recess in a base member. The insert members may be oriented in different orientations to position a softer, less dense region at different locations, to situate the softer, less dense region of the insert beneath a particular user's ischial tuberosities and/or coccyx.

24 Claims, 4 Drawing Sheets

U.S. PATENT DOCUMENTS

| | | | | | |
|---|---|---|---|---|---|
| 5,390,384 | A | * | 2/1995 | Dinsmoor et al. | 5/654 |
| 5,395,162 | A | | 3/1995 | Jay | |
| 5,407,248 | A | | 4/1995 | Jay | |
| 5,414,884 | A | | 5/1995 | Mackenzie | |
| 5,442,823 | A | | 8/1995 | Siekman | |
| 5,457,833 | A | | 10/1995 | Jay | |
| 5,490,299 | A | | 2/1996 | Dinsmoor, III | |
| 5,522,106 | A | * | 6/1996 | Harrison et al. | 5/653 |
| 5,524,971 | A | | 6/1996 | Jay | |
| 5,592,707 | A | | 1/1997 | Dinsmoor, III | |
| 5,593,211 | A | | 1/1997 | Jay | |
| 5,617,595 | A | | 4/1997 | Landi | |
| 5,647,637 | A | | 7/1997 | Jay | |
| 5,671,977 | A | | 9/1997 | Jay | |
| 5,681,092 | A | | 10/1997 | Hanson | |
| 5,687,436 | A | | 11/1997 | Denton | |
| 5,701,621 | A | | 12/1997 | Landi | |
| 5,836,654 | A | | 11/1998 | DeBellis | |
| 5,857,749 | A | | 1/1999 | DeBellis | |
| 5,950,263 | A | | 9/1999 | Hanson | |
| 6,082,824 | A | * | 7/2000 | Chow | 297/452.56 |
| 6,142,573 | A | | 11/2000 | Harding | |
| 6,241,320 | B1 | | 6/2001 | Chew | |
| 6,347,406 | B1 | * | 2/2002 | Jones et al. | 2/69 |
| 6,625,830 | B2 | * | 9/2003 | Lampel | 5/653 |
| 6,739,008 | B1 | | 5/2004 | Kindrick | |
| 6,918,146 | B2 | * | 7/2005 | England | 5/653 |
| 7,220,376 | B2 | * | 5/2007 | Hetzel et al. | 264/125 |
| 7,445,292 | B2 | * | 11/2008 | Moule | 297/452.25 |
| 2006/0170274 | A1 | * | 8/2006 | Moule | 297/452.25 |

FOREIGN PATENT DOCUMENTS

| | | |
|---|---|---|
| FR | 2687294 | 8/1993 |
| WO | 02588513 | 8/2002 |

* cited by examiner

WHEELCHAIR SEAT CUSHION

CROSS-REFERENCE TO RELATED APPLICATIONS

This application claims the benefit of U.S. Provisional Application No. 60/848,417, filed Sep. 29, 2006, the disclosure of which is incorporated herein by reference.

BACKGROUND OF INVENTION

The present invention generally relates to wheelchairs and, more particularly, to wheelchair seat cushion systems which are adaptable to the anatomical structure of the user and/or adjustable to achieve support-related objectives for a given user.

In general, wheelchairs include seat cushions that are constructed from flexible material. However, the flexible material does not provide optimum support or comfort for the user. Foam and air filled seat cushions have been developed to provide improved support for users requiring special support, such as paraplegics or users having spinal deformities or muscular atrophy, but these seat cushions are difficult to adjust to accommodate specific needs and proportions of individual users and do not encourage proper control of body position. Furthermore, users often become oversensitive to pressures against their skin and bodies so that it is desirable to develop a support cushion that exerts low pressures against a user's body and skin.

What is needed is a support cushion that not only conforms to the shape of the user's body, but also provides stabilizing forces that allow for postural control. Such a support cushion should provide a stable platform to permit improved control of body position and posture. Furthermore, such a support cushion must be durable and able to withstand extensive use for extended periods of time.

SUMMARY OF INVENTION

The present invention is directed toward a seat cushion assembly that includes multi-density regions. In one embodiment, a first region having a stiffer, higher density is proximate the front of the seat cushion assembly beneath a second region having a softer, lower density region that is adapted to support a user's thighs, wherein the first region is sufficiently stiff and dense to assist the user in exiting the wheelchair.

In another embodiment of the invention, an insert member having multi-density regions is adapted to be received in a recess in a base member. The insert member may be adjusted relative to the recess to orient the insert member in different orientations so as to position a softer, less dense region at different locations and thus situate the softer, less dense region beneath a particular user's ischial tuberosities and/or coccyx.

DETAILED DESCRIPTION

Figure 1:
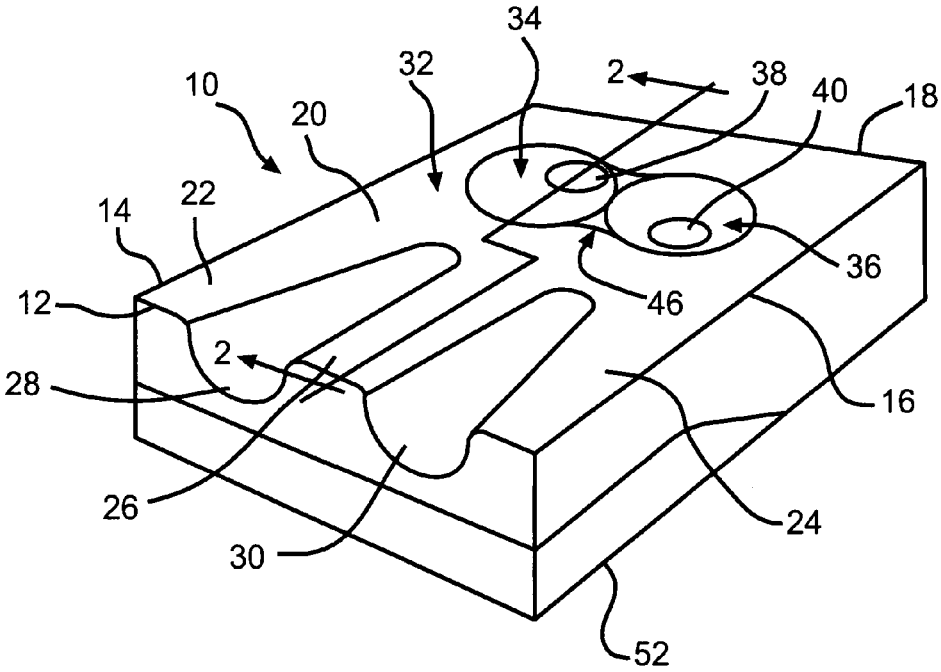
FIG. 1 is a perspective view of a wheelchair seat cushion assembly.

Referring now to the drawings, there is a perspective view in FIG. 1 of a seat cushion assembly, generally indicated at 10, having a front edge 12, side edges 14, 16 and a rear edge 18. The seat cushion also has a top surface 20 which may be sculpted or contoured for the comfort of the person sitting on the seat and to provide improved posture, weight distribution and lateral support to a user such that the user remains properly centered upon the seat cushion. The illustrated seat cushion includes raised perimeter adductor regions or ridges 22, 24 proximate the outer sides of the cushion and the user's legs and a raised central abductor region or ridge 26 proximate the front of the cushion between the user's legs. The perimeter ridge may be edged or may be rounded, as shown, to provide a smoother transition. Concaved areas or valleys, such as the horse-shoe shaped depressions 28, 30 shown, may be formed between the adductor and abductor regions or ridges 22, 24, 26 to receive and support the thighs. As will be appreciated by those skilled in the art, the buttocks and thighs of the wheelchair occupant are thus supported. The user's legs also may be positioned in a manner preventing abduction, adduction and wind sweeping. In addition, by providing support to the sides of a user's legs, the contoured top surface 20 tends to center the user's hips and body upon the top surface 20 of the seat cushion assembly 10, thus providing improved weight distribution.

The seat cushion assembly 10 uses a relatively stiff cushion base member, generally indicated at 32, which may be anatomically contoured, and which is used in combination with one or more relatively soft seat cushion insert members 34, 36, attached to the base member 32 in any suitable matter, such as by releasable fasteners (e.g., hook and loop fasteners) or permanent attachment (e.g., bonding). The cushion insert members 34, 36 are preferably removably attached. The seat cushion insert members 34, 36 preferably have a still softer cushion region 38, 40, which is adapted to be positioned in the region of the user's ischial tuberosities and/or coccyx. The softer seat cushion insert members 34, 36 allow the user to sink into the seat cushion assembly 10 in a manner increasing the contact area and distributing the pressure, while the relatively stiff underlying seat cushion base member 32 provides the necessary anatomical reinforcement of the cushion contours so as to laterally stabilize the user on the seat cushion assembly 10.

The seat cushion assembly 10 may be made of any suitable material, including, for example, an open cell foam of the type commonly used in forming seat cushions. Although many foam types may be used, adequate results may be obtained with an open cell polyurethane foam that has a sufficient thickness and resiliency to safely support a user. The foam may be any suitable density and resiliency provided that it provides adequate support.

The density of the seat cushion base member 32 is preferably less than about 10 pounds per cubic foot, and most preferably in the range of about 3 to about 5 pounds per cubic foot. The preferred seat cushion base member 32 is a 3.3 pound per cubic foot molded high resiliency open-cell polyurethane foam cushion having a thickness dimension of about 2¼ inches. Alternatively, properties of the seat cushion base member 32 may be expressed in terms of stiffness variations, which are commonly measured in terms of an indentation load deflection (ILD). This measurement standard is known in the art and can be referenced in ASTM Standard Test D-3574-81, the disclosure of which is hereby incorporated by reference into this specification. In the preferred form, the seat cushion base member 32 is a high resiliency polyurethane foam that has a softness that measures less than 100 pounds using the ILD test at 25% deflection over a 50 square inch area, and most preferably the ILD is about 20 pounds at 25% to about 60 pounds at 65%. It is believed that significant safety would be achieved with foam cushions down to a thickness of about one inch, and possibly less, or that ILD ratings at 25% deflection as low as about 15 to 20 pounds could be used, particularly with thicker cushions. A cushion 2¼ inches thick, however, is regarded in the industry as a relatively "low profile" cushion that makes the transfer of a user in and out of the wheelchair easier.

Figure 2:
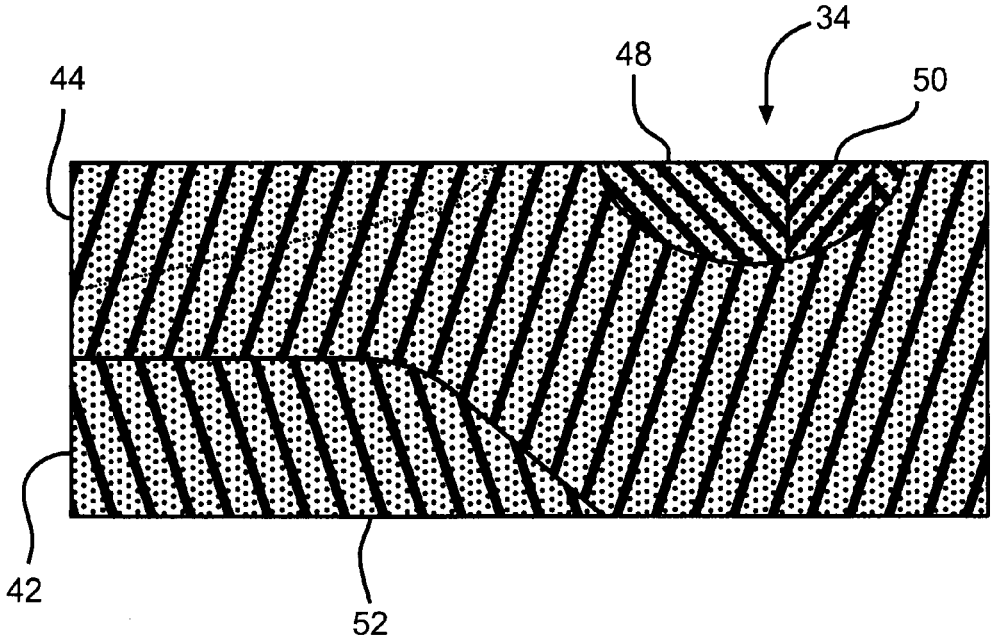
FIG. 2 is an enlarged cross-sectional view of the seat cushion assembly taken along the line 2-2 in FIG. 1.

FIG. 2 shows a cross-sectional view of the seat cushion assembly 10 of FIG. 1, including the relatively stiff seat cushion base member 32 (shown in FIG. 2), which has multi-density regions and a removable, relatively soft and flexible seat cushion insert member 34. The sensitivity of each user to the formation of pressure sores varies from individual to individual. Consequently, one can vary the softness, density and thickness of the seat cushion assembly 10 to provide considerable protection for the user against pressure sores.

The seat cushion base member 32 may comprise one or more elements, including, for example, a first element 42 and a second element 44, as shown, removably attached or bonded together, so as to form multi-density regions. The first element 42 may have a ramped or tapered surface that mates contiguously with the second element 44 to provide a softer or smoother transition between the elements 42, 44. The first element 42 is preferably proximate the front of the seat cushion base member 32 so as to be situated beneath the concaved areas or valleys or depressions 28, 30 in the seat cushion assembly 10 that receive and support the user's thighs. The second element 44 preferably covers the tapered surface and a top surface of the first member 42.

The first and second elements 42, 44 may be comprised of different stiffness of material. The first element 42 is preferably stiff in order to assist the user in exiting the wheelchair. Typically, when exiting a wheelchair, the wheelchair user slides forward, momentarily placing all of their weight on the first element 42. If the first element 42 is stiff, the transition from the wheelchair into another waiting vehicle or bed is more easily accomplished. The stiffness of the first element 42 is preferably between about 60 ILD and about 120 ILD. Most preferably, the stiffness of the first element 42 is about 70 ILD. The second element 44 is preferably less stiff than the first element 42. The stiffness of the second element 44 can range from about 25 ILD to about 35 ILD, with a preferred measurement being about 30 ILD.

It should be appreciated that the density of the seat cushion base member 32 may be selected so as to permit the user's thighs to compress a softer and flexible material having a lower density, like the second element 44, while being safely supported by an underlying material having a greater density, like the first element 42. It should be further appreciated that the surface area contacted and supported by the second element 44 is sufficient to adequately distribute the user's weight and reduce the likelihood of the formation of pressure sores. Additionally, as the user sinks into softer, less dense material of the second element 44, he or she becomes more laterally stable. This increased stability is enhanced by the contoured nature of the top surface of the seat cushion. The combination, for example, of downwardly sloping sides of the adductor regions or ridges 22, 24 and upwardly sloping sides of the abductor region or ridge 26 gives the user a high degree of lateral stability, which is important for propelling the wheelchair and maintaining a good pelvic position while sitting in the wheelchair. The increased immersion of the user into the second element 44 also aids in the user's ability to touch the floor and consequently, to self propel the wheelchair.

As stated above, the seat cushion assembly 10 is adapted to be used with the seat cushion insert members 34, 36, which are adapted to be received into a recess 46 in the seat cushion base member 32, and thereby provide support for the user's buttocks region, particularly the user's ischial tuberosities and/or coccyx. The recess 46 can take the form of a generally oval-shaped recess, which may vary in depth from about one-half inch proximate the sides to about one and one-quarter inches proximate the center line of the foam cushion.

One or more seat cushion insert members 34, 36 may be mounted in the recess 46. The seat cushion insert members 34, 36 may take the form of foam insert members, which are even softer than the seat cushion base member 32. More particularly, the seat cushion insert members 34, 36 may be formed of a foam having an ILD less than the surrounding cushion member, for example, below about 20 pounds at about 25% over about 50 square inches so as to permit the user's bony prominences to sink into the seat cushion insert members 34, 36 for pressure equalization while still providing some support pressure in this region. Alternatively, the seat cushion insert members 34, 36 may be formed of a visco-elastic foam which also has a softness less than the surrounding seat cushion base member 32 and sufficiently slow recovery to permit the user to lift up slightly from the insert members 34, 36 and shift laterally before the insert members 34, 36 return to their full height.

In FIG. 2, a seat cushion insert member 34 is shown having multi-density regions, which each contains a material for localized deformation of the insert member 34 under the weight of a user seated on the seat cushion assembly 10. The seat cushion insert member 34 may comprise a first padding material 48, which may have one or more cut-out portions for receiving a second padding material 50 having a lower density in contrast with the first padding material 48, to reduce contact to certain areas of the user for therapeutic purposes. The first and second padding materials 48, 50 may be bonded together.

Figure 3:
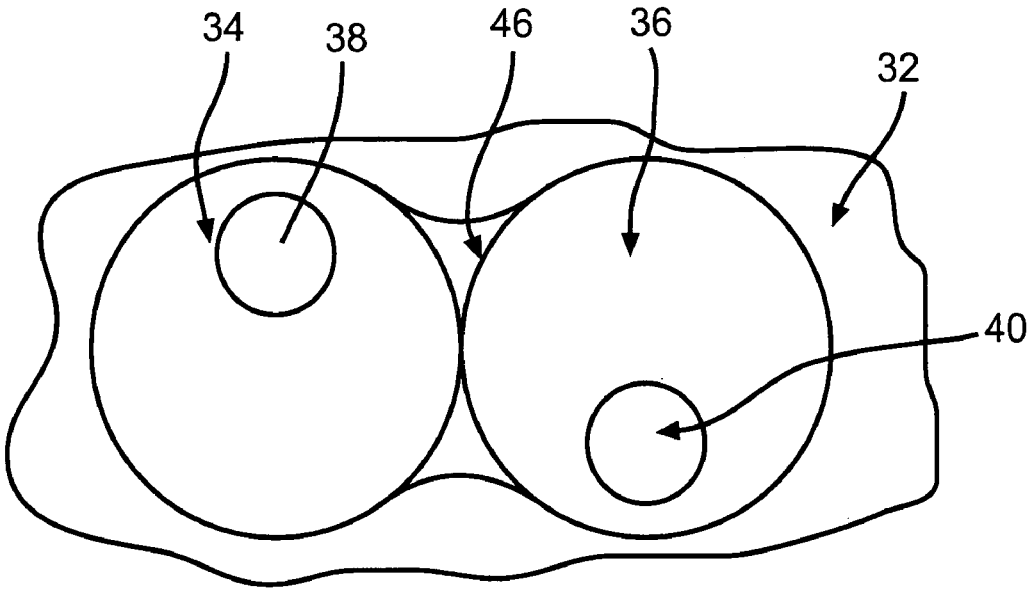
FIG. 3 is an enlarged partial top plan view of the seat cushion assembly shown in FIG. 1.
Figure 4:
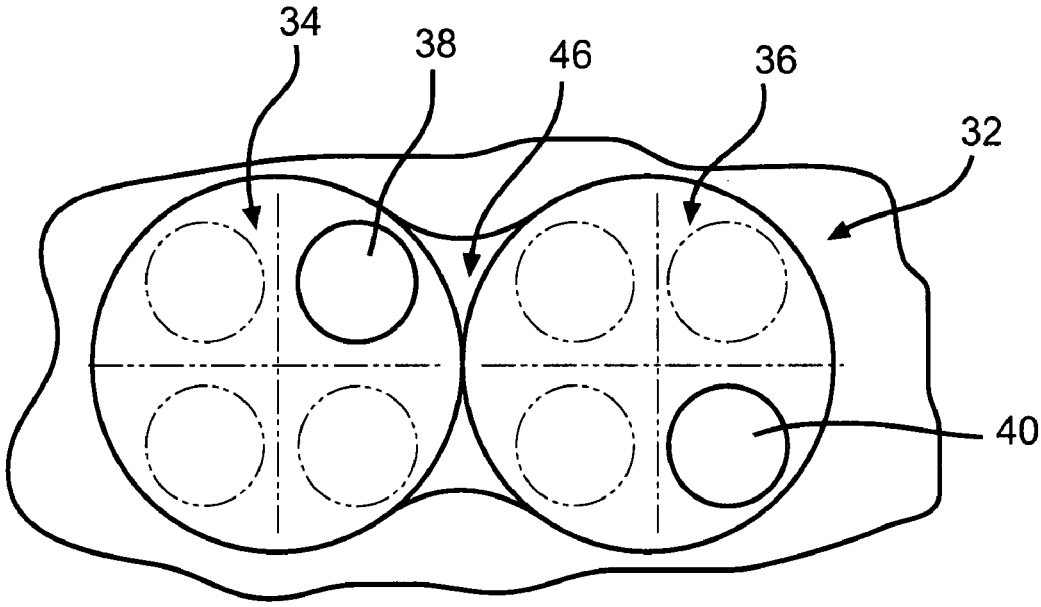
FIG. 4 is a partial top plan view of the seat cushion assembly as shown in FIG. 3, showing, in phantom line, alternative positions of seat cushion insert members.
Figure 5A:
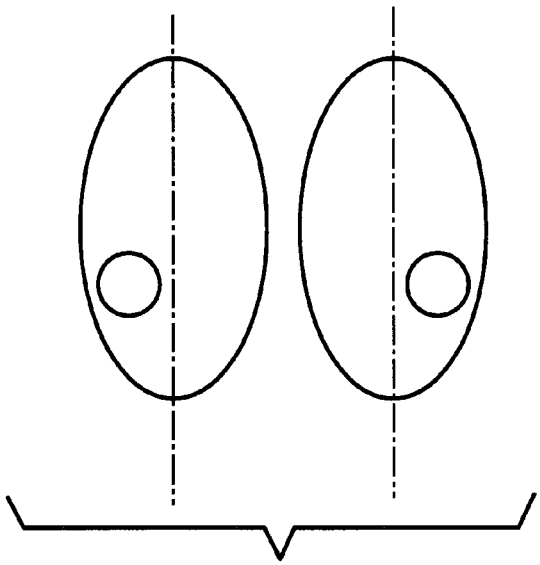
FIGS. 5A-K are top plan views of the various seat cushion insert members.
Figure 5B:
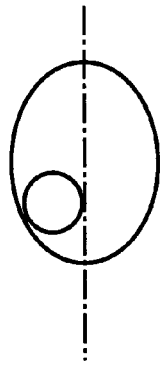
Figure 5C:
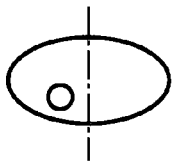
Figure 5D:
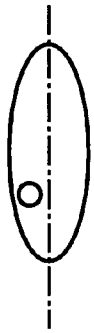
Figure 5E:
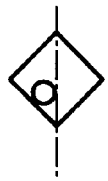
Figure 5F:
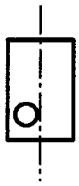
Figure 5G:
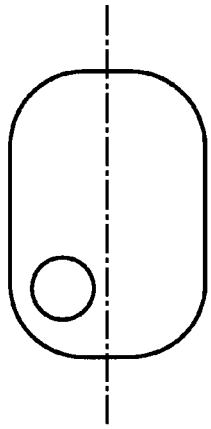
Figure 5H:
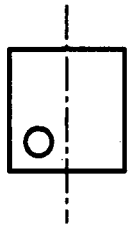
Figure 5I:
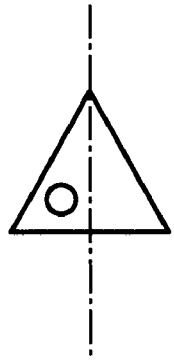
Figure 5J:
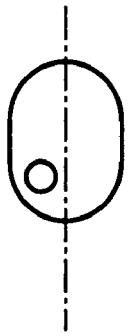
Figure 5K:
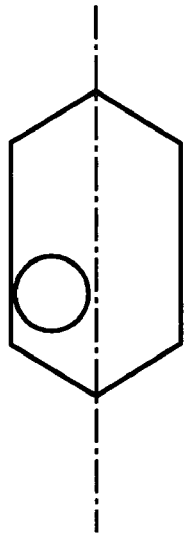

It should be noted, as shown in FIG. 3, that the seat cushion insert members 34, 36 may be oriented in orientations to position the softer, less dense second padding material 50 (shown in FIG. 2) at different locations, depending on where the user's ischial tuberosities and/or coccyx contact the seat cushion insert members 34, 36. In this way, the seat cushion assembly 10 may be easily adjusted to accommodate different users. As shown in FIG. 4, the seat cushion insert members 34, 36 may be rotated (i.e., clockwise or counter-clockwise when viewing FIG. 4) to a desired position, such as in one of the four quadrants shown in phantom lines in FIG. 4. It should be appreciated that substantially circular seat cushion insert members, such as the seat cushion insert members 34, 36 shown in FIG. 4, may be rotated to infinite positions and thus may be infinitely adjustable. Other variations in seat cushion insert members are shown in FIGS. 5A-K. These include oval, elliptical and egg-shaped seat cushion insert members, square and rectangular seat cushion insert members, triangular seat cushion insert members, and seat cushion insert members of other polygonal shapes. The seat cushion insert members may have rounded edges or corners and may cooperate with the recess 46 at different orientation. Although the second padding material of each of the seat cushion insert members is shown to be circular, it may be other shapes. It should be appreciated the shapes that are symmetrical along at least one axis may be used on the left and right sides of the recess 46. For example, the seat cushion insert members in FIG. 5A may be positioned as shown or rotated 180 degrees (i.e., clockwise or counter-clockwise with viewing FIG. 5A) to provide two adjustment positions. For additional adjustment positions, the seat cushion insert members shown on the left in FIG. 5A may be used in two adjustment positions on the right, and the seat cushion insert members shown on the right in FIG. 5A may be used in two adjustment positions on the left. This provides four adjustment positions. Additionally, it is conceivable that the seat cushion insert members 34, 36 may be flipped over. By providing a third padding material (not shown) adjacent the second padding material 50, and on the opposite side (i.e., the blind side of the seat cushion insert members 34, 36 when viewing FIG. 3 or 4), flipping the insert members 34, 36 could expose the third padding material, which could be a different density in contrast to the second padding material 50 to offer greater versatility.

The seat cushion assembly 10 is formed for use on a wheelchair seat base (not shown), which can take the form of a relatively rigid seat pan or a sling-type seat. The seat cushion assembly 10 preferably substantially covers the entire area of the seat base, and most preferably overlaps a front edge and a rear edge of the seat base. The seat cushion assembly 10 has a downwardly facing surface 52, which may substantially mate with the seat base. As illustrated, the downwardly facing surface 52 is planar, but it should be understood that, if the seat base were contoured, the downwardly facing surface 52 could include a substantially mating downwardly facing contour.

The seat cushion assembly 10 may also include a very soft fluid pouch (not shown) to provide additional low pressure support, especially in the ischial/coccyx region. The fluid pouch may contain, for example, a viscous thixotropic fluid or flowable mixture of microballoons and lubricant. Such fluid pouches are well known in the wheelchair seating industry and are described in more detail, for example, in U.S. Pat. Nos. 4,726,624, 5,189,747, 5,395,162 and 5,378,045, the entire disclosures of which are incorporated herein by reference. The details of such microballoon-based fluid-like materials will not be describe further, other than to note that they are highly effective in providing low pressure support, which is extremely beneficial in the area of supporting bony prominences.

The seat cushion assembly 10 may further include a water-impervious elastomeric sheet or envelope, which may be mounted over the seat cushion base and insert members 32, 34, 36, and which may protect the members 32, 34, 36 from the absorption of liquids. The elastomeric sheet or envelope may be formed of a substantially water-free impervious material in order to protect the seat cushion base and insert members 32, 34, 36 against the entry of moisture therein. Perspiration, urine and spilled liquids are all commonly encountered problems that will tend to degrade wheelchair cushions. The sheet or envelope, therefore, could protect the seat cushion base and insert members 32, 34, 36 from contamination and physical break-down as a result of prolonged contact with such liquids.

Finally, the seat assembly may include a fabric cover (not shown). The cover may be mounted over the seat cushion base and insert members 32, 34, 36 and the sheet or envelope to provide a more comfortable interface between the user and the seat cushion assembly 10. The cover may optionally include a pocket in which an insert member, such as the fluid pouch, may be inserted to provide considerable protection for the user against pressure sores from sitting on the seat cushion assembly 10.

It should be understood that the seat cushion assembly 10 may be secured in place on the wheelchair seat base by fasteners, such as hook and loop-type fastener strips (not shown), which may be secured to the outside of the bottom panel of the cover and coupled to strips (not shown) mounted on the seat base.

It should be appreciated that the seat cushion insert members, like the seat cushion, may be pre-contoured to conform to the user's anatomy. It should be understood that the seat cushion insert members may be in the form of different density materials to distribute the load of the user as desired, a single density pre-contoured material, or both.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A wheelchair seat cushion assembly, comprising:

a base member having a top surface and a recess formed in the top surface, the recess being configured to support a plurality of seat cushion inserts; and one or more seat cushion insert members, the one or more seat cushion insert members each having multi-density regions that include a first pad that has at least one cut-out portion and a second pad inserted in the cut-out portion of the first pad, the seat cushion insert members being configured to be positioned within the recess to arrange the second pad in different orientations in relation to the base member, the seat cushion insert members including a third pad positioned in the cutout adjacent to the second pad and being configured to be oriented in different orientations in relation to the base member to position the second and third pads in different rotated positions in relation to the base member.

2. The assembly of claim 1 wherein the multi-density regions comprise a material for localized deformation of the seat cushion insert members under the weight of a user seated on the seat cushion assembly.

3. The assembly of claim 1 wherein the multi-density regions comprise a region that is softer than the rest of the seat cushion insert members, the seat cushion insert members being configured to be positioned in relation to the recess in a region corresponding to the ischial tuberosities and/or coccyx of a user.

4. The assembly of claim 1 wherein the second pad has a lower density in contrast with the first pad.

5. The assembly of claim 4 wherein the first and second pads are bonded together.

6. The assembly of claim 1 wherein the seat cushion insert members are configured to be rotated in relation to the recess.

7. The assembly of claim 1 wherein the seat cushion insert members are polygonal shapes that are symmetrical along at least one axis so as to be interchangeably used on left and right sides of the recess.

8. The assembly of claim 1 wherein the seat cushion insert members are substantially circular seat so that the seat cushion insert members are configured to be rotated in a plane to infinite positions in relation to the recess.

9. The assembly of claim 1 wherein the seat cushion insert members are contoured to conform to the user's anatomy.

10. The assembly of claim 1 wherein the base member has multi-density regions.

11. A wheelchair seat cushion assembly, comprising:

a base member having a top surface and a recess formed in the top surface, the recess being configured to support a plurality of seat cushion inserts; and one or more seat cushion insert members, the one or more seat cushion insert members each having multi-density regions that include a first pad that has at least one cut-out portion and a second pad inserted in the cut-out portion of the first pad, the seat cushion insert members being configured to be positioned within the recess to arrange the second pad in different orientations in relation to the base member, the seat cushion insert members being substantially circular so that the seat cushion insert members are configured to be rotated in a plane to infinite positions in relation to the recess.

12. The assembly of claim 11 wherein the top surface is contoured.

13. The seat cushion assembly of claim 11 wherein the base member comprises one or more elements including a first element and a second element, the first and second elements being different densities to form base member multi-density regions.

14. The assembly of claim 13 wherein the first and second elements are removably attached together.

15. The assembly of claim 13 wherein the first and second elements are bonded together.

16. The assembly of claim 13 wherein the first element has a ramped surface that mates contiguously with the second element to provide a smooth transition between the elements.

17. The assembly of claim 13 wherein the first element is proximate the front of the seat cushion base member so as to be situated beneath the thighs of a user.

18. The assembly of claim 13 wherein the first element is stiffer than the second element.

19. The assembly of claim 11 wherein the multi-density regions comprise a material for localized deformation of the seat cushion insert members under the weight of a user seated on the seat cushion assembly.

20. The assembly of claim 11 wherein the multi-density regions comprise a region that is softer than the rest of the seat cushion insert members, the seat cushion insert members being configured to be positioned in relation to the recess in a region corresponding to the ischial tuberosities and/or coccyx of a user.

21. The assembly of claim 11 wherein the second pad has a lower density in contrast with the first pad.

22. The assembly of claim 21 wherein the first and second pads are bonded together.

23. The assembly of claim 11 wherein the seat cushion insert members include a third pad positioned in the cutout adjacent to the second pad and the seat cushion inserts are configured to be oriented in different orientations in relation to the base member to position the second and third pads in different rotated positions in relation to the base member.

24. The assembly of claim 11 wherein the seat cushion insert members are contoured to conform to the user's anatomy.

* * * * *